US012313324B2

(12) United States Patent
Corey et al.

(10) Patent No.: US 12,313,324 B2
(45) **Date of Patent: *May 27, 2025**

(54) CRYOGENIC FREEZER

(71) Applicant: MVE Biological Solutions US, LLC, Brentwood, TN (US)

(72) Inventors: John Corey, Melrose, NY (US); Keith Gustafson, Waleska, GA (US); Buzz Bies, Manchester, NH (US)

(73) Assignee: MVE Biological Solutions US, LLC, Brentwood, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/227,173

(22) Filed: Jul. 27, 2023

(65) Prior Publication Data

US 2023/0384016 A1 Nov. 30, 2023

Related U.S. Application Data

(63) Continuation of application No. 16/182,878, filed on Nov. 7, 2018, now Pat. No. 11,788,783.
(Continued)

(30) Foreign Application Priority Data

Nov. 7, 2017 (JP) ..... 2017-214614

(51) Int. Cl.
*F25B 9/14* (2006.01)
*F25D 3/10* (2006.01)
(Continued)

(52) U.S. Cl.
CPC ..... *F25D 11/04* (2013.01); *F25B 9/14* (2013.01); *F25B 9/145* (2013.01); *F25D 3/105* (2013.01);
(Continued)

(58) Field of Classification Search
CPC .. F25B 9/145; F17C 3/08; F17C 3/085; F25D 11/04; F25D 19/02; F25D 19/006;
(Continued)

(56) References Cited

U.S. PATENT DOCUMENTS 3,909,225 A 9/1975 Rooney
4,344,302 A 8/1982 Jarrett, Jr. et al.
(Continued)

FOREIGN PATENT DOCUMENTS

EP 1087193 A1 3/2001
JP 60-245285 A 12/1985
(Continued)

OTHER PUBLICATIONS

JPO; Notice of Refusal dated Mar. 16, 2021 in Japanese Application No. 2017-214614.
(Continued)

*Primary Examiner* — Brian M King
(74) *Attorney, Agent, or Firm* — Snell & Wilmer L.L.P.

(57) ABSTRACT

A cryogenic freezer features a dewar defining a storage space. A reservoir is positioned within or adjacent to the storage space and is configured to contain a cryogenic liquid with a headspace above the cryogenic liquid in a reservoir interior space that is sealed with respect to the storage space. A refrigeration module is in heat exchange relationship with the reservoir. A sensor is configured to determine a temperature or pressure within the reservoir. A system controller is connected to the sensor and the refrigeration module and configured so that the refrigeration module is adjusted to provide additional cooling to the reservoir when a pressure or temperature within the headspace increases.

18 Claims, 9 Drawing Sheets

Related U.S. Application Data

(60) Provisional application No. 62/627,575, filed on Feb. 7, 2018.

(51) Int. Cl.

| | |
|---|---|
| ***F25D 11/04*** | (2006.01) |
| ***F25D 17/06*** | (2006.01) |
| ***F25D 19/00*** | (2006.01) |
| ***F25D 19/02*** | (2006.01) |
| ***F25D 23/00*** | (2006.01) |
| ***F25D 29/00*** | (2006.01) |

(52) U.S. Cl.
CPC ..... *F25D 17/06* (2013.01); *F25D 19/006* (2013.01); *F25D 19/02* (2013.01); *F25D 23/003* (2013.01); *F25D 29/008* (2013.01); *F25D 2201/14* (2013.01); *F25D 2600/04* (2013.01); *F25D 2700/12* (2013.01); *F25D 2700/121* (2013.01)

(58) Field of Classification Search
CPC ..... F25D 3/105; F25D 29/008; F25D 23/003; F25D 17/06; F25D 2700/12; F25D 2700/121; F25D 2201/14; F25D 2600/04
See application file for complete search history.

(56) References Cited

U.S. PATENT DOCUMENTS

| | | | |
|---|---|---|---|
| 4,712,607 | A | 12/1987 | Lindemans et al. |
| 5,275,007 | A | 1/1994 | Neeser |
| 5,293,758 | A | 3/1994 | Ames et al. |
| 5,357,758 | A | 10/1994 | Andonian |
| 5,419,143 | A | 5/1995 | Leonard et al. |
| 5,590,537 | A | 1/1997 | Vogel |
| 5,794,450 | A | 8/1998 | Alexander |
| 5,906,101 | A | 5/1999 | Rajotte et al. |
| 5,921,102 | A | 7/1999 | Vago |
| 5,964,095 | A | 10/1999 | Coelho et al. |
| 6,393,847 | B1 | 5/2002 | Brooks et al. |
| 6,550,255 | B2 | 4/2003 | Rudick et al. |
| 7,628,022 | B2 | 12/2009 | Spoor et al. |
| 8,065,883 | B2 | 11/2011 | Pozivil |
| 9,612,062 | B2 | 4/2017 | Ri et al. |
| 9,709,313 | B2 | 7/2017 | Miki |
| 9,719,736 | B1 | 8/2017 | Pourrahimi et al. |
| 10,704,809 | B2 | 7/2020 | Longsworth et al. |
| 10,724,686 | B2 | 7/2020 | Stautner et al. |
| 2001/0012814 | A1 | 8/2001 | May et al. |
| 2002/0002830 | A1 | 1/2002 | Strobel |
| 2002/0121095 | A1 | 9/2002 | Adamski et al. |
| 2004/0055313 | A1 | 3/2004 | Navedo et al. |
| 2004/0144101 | A1 | 7/2004 | Hofmann |
| 2006/0010881 | A1 | 1/2006 | Gustafson |
| 2006/0086102 | A1 | 4/2006 | Dickerson et al. |
| 2006/0260327 | A1 | 11/2006 | Kanamori et al. |
| 2009/0200320 | A1 | 8/2009 | Saito et al. |
| 2010/0016168 | A1 | 1/2010 | Atkins et al. |
| 2011/0126553 | A1 | 6/2011 | Ball-Difazio |
| 2013/0008187 | A1 | 1/2013 | Kraus et al. |
| 2014/0020408 | A1 | 1/2014 | Berchowitz |
| 2014/0311166 | A1 | 10/2014 | Buelow et al. |
| 2015/0033767 | A1 | 2/2015 | Corey et al. |
| 2016/0078987 | A1 | 3/2016 | Simpkins et al. |
| 2017/0051874 | A1 | 2/2017 | Strobel |
| 2019/0049169 | A1 | 2/2019 | Ciyanoglu et al. |
| 2019/0137163 | A1 | 5/2019 | Corey et al. |
| 2020/0085036 | A1 | 3/2020 | Creasey et al. |

FOREIGN PATENT DOCUMENTS

| | | | |
|---|---|---|---|
| JP | H0669030 | A | 3/1994 |
| JP | H06294683 | A | 10/1994 |
| JP | H0712454 | A | 1/1995 |
| JP | 2001-12814 | A | 1/2001 |
| JP | 2003148827 | A | 5/2003 |
| JP | 2006200771 | A | 8/2006 |
| JP | 2008518183 | A | 5/2008 |
| JP | 2014157011 | A | 8/2014 |
| KR | 20100070455 | A | 6/2010 |
| KR | 20110105353 | A | 9/2011 |
| KR | 20120083221 | A | 7/2012 |
| WO | 0018225 | A1 | 4/2000 |

OTHER PUBLICATIONS

KR; Notice of Preliminary Rejection dated Jun. 17, 2022 in Application Serial No. 2018-0053212.
JP; Notice of Decision to Grant Patent dated Jun. 27, 2022 in Application Serial No. 2017-214614.
EP; Search Report dated Jun. 5, 2003 in Application No. EP01310951.
JP; Decision of Refusal dated Dec. 14, 2021 in Japanese patent application No. 2017-214614.
AGIPA; Examination Report No. 1 dated Jun. 21, 2023 in Application No. 2018203168.
AU; Second Office Action dated Nov. 24, 2023 in Application Serial No. 2018203168.
USPTO; Office Action dated Aug. 4, 2020 in U.S. Appl. No. 16/182,878.
USPTO; Office Action dated Dec. 14, 2020 in U.S. Appl. No. 16/182,878.
USPTO; Office Action dated Aug. 23, 2021 in U.S. Appl. No. 16/182,878.
USPTO; Final Office Action dated Feb. 16, 2022 in U.S. Appl. No. 16/182,878.
USPTO; Office Action dated Jul. 17, 2022 in U.S. Appl. No. 16/182,878.
USPTO; Final Office Action dated Feb. 10, 2023 in U.S. Appl. No. 16/182,878.
USPTO; Notice of Allowance dated May 18, 2023 in U.S. Appl. No. 16/182,878.
JPO; Examination Report dated Apr. 9, 2024 in Application Serial No. 2023-086075.
AU; Third Examination Report dated May 8, 2024 in Application Serial No. 2018203168.
KR; First Examination Report dated Mar. 6, 2024 in Application Serial No. 10-2023-0094254.
KR; Notice of Allowance dated Apr. 24, 2023 in Application Serial No. 10-2018-0053212.
JP; Final Office Action dated Nov. 12, 2024 in Application Serial No. 2023-086072.
CA; First Office Action dated Aug. 28, 2024 in Application Serial No. 3004114.
KR; Notice of Allowance dated Nov. 25, 2024 in Application Serial No. 10-2023-0094254.

CRYOGENIC FREEZER

CROSS-REFERENCE TO RELATED APPLICATIONS

This application is a continuation of and claims priority to U.S. patent application Ser. No. 16/182,878, entitled "CRYOGENIC FREEZER" which was filed on Nov. 7, 2018. U.S. application Ser. No. 16/182,878 claims priority to U.S. Provisional Application Ser. No. 62/627,557, entitled "CRYOGENIC FREEZER" which was filed on Feb. 2, 2018, and also claims priority to Japanese Patent Application Serial No. 2017-214614, entitled "CRYOGENIC FREEZER" which was filed on Nov. 7, 2017. The contents of each of the foregoing applications are hereby incorporated herein by reference.

FIELD OF THE INVENTION

The present invention relates generally to freezers or dewars for storing materials at low temperatures and, in particular, to a cryogenic freezer that uses a mechanical refrigeration system in combination with a cryogenic fluid reservoir to provide cooling.

BACKGROUND

When storing biological material in cryogenic freezers, there is a desire to maintain the specimens at a uniform, controlled low temperature. In addition to the temperature being uniform, the desired temperature itself varies with the type of material being stored and its intended use. For the long term storage of biological cells, for example, it is desirable to keep the temperature below −160° C. For short term storage of blood plasma, or transplant tissue, −50° C. is all that is required. To handle the different requirements for storage, cryogenic freezers have evolved along two separate paths: liquid nitrogen (or "LN2") cooled or mechanically cooled.

A conventional LN2 cryogenic dewar is indicated in general at 10 in FIG. 1 and features an outer shell 12 housing an inner tank 14. The outer shell and inner tank are separated by vacuum-insulated space 16 and a removable insulated lid or plug 18 permits access to the interior of the inner tank. A number of stainless steel storage racks, one of which is illustrated at 22, holding boxes containing biological specimens are positioned inside the dewar. The racks rest on a circular turn tray platform 26. To access storage racks 22, a user rotates the tray 26 using handles 28. At the bottom of the dewar is a pool 32 of liquid nitrogen (−196° C.) which keeps the biological specimens in the dewar cool by evaporating.

With the dewar 10 of FIG. 1, the racks are not in direct contact with the liquid nitrogen, but rather reside in the vapor space above the liquid. The temperature of the racks thus varies with the distance from the liquid nitrogen, as the vapor stratifies with warmer gas above colder gas. More specifically, the lowest temperatures are near the bottoms of the racks, nearest to the nitrogen pool, while the highest temperatures are near the tops of the racks, farthest from the pool.

More modem dewars make use of thermally conductive materials for the racks and in the dewar construction to minimize this temperature stratification and make it close to the liquid nitrogen pool temperature from top to bottom. An example of such a dewar is presented in commonly owned U.S. Pat. No. 6,393,847 to Brooks et al. The Brooks et al.

'847 patent discloses a dewar with a pool of liquid cryogen in the bottom and a turntable or rotatable tray featuring a cylindrical sleeve. The cylindrical sleeve features a skirt which extends down into the pool of liquid cryogen so as to transfer heat away from biological samples stored on the tray. While such anti-stratification methods work, the temperatures in the dewar tend to be close to LN2 temperature, making such dewars most suitable for long-term storage applications.

Mechanical freezers work in much the same manner as a home freezer. An insulated container is cooled by an electrically-powered refrigeration system. Some refrigeration systems use a cryogenic liquid as the refrigerant. Mechanical freezers are limited, however, in the temperature they can achieve; in part by the efficiency of the insulation of the freezer, due at least in part to the box-shaped, door-equipped configuration of most mechanical freezers, and in part by the limits of the refrigeration system itself. Mechanical freezers tend to operate in the −40° C. to −100° C. temperature ranges. Furthermore, conventional vapor-compression mechanical refrigeration systems require refrigerants that boil and condense at suitable temperatures for cold and hot sides of the refrigerating device. No such refrigerants exists to span from LN2 temperature (approximately 77° K) to room temperature (approximately 300° K).

The greatest disadvantage presented by mechanical freezers is their dependence on electricity to operate. If the power goes out or the refrigeration system fails, the freezer will warm up in a short period of time (a couple of days). With liquid nitrogen freezers, if the power fails or the liquid level controller fails, the pool of nitrogen in the bottom of the dewar will typically provide a month of refrigeration. For this reason, the freezer market tends to favor the use of liquid nitrogen freezers in situations that require low temperature storage or where high value materials are cooled. Mechanical freezers are used in situations that don't require extremely low temperatures or to cool contents that are more easily replaced.

Conventional liquid nitrogen freezers have two inherent problems maintaining uniform, yet selectable temperatures. First, as mentioned previously, the liquid nitrogen refrigerant is stored in the bottom of the freezer. Since cold gas is denser than warm gas, freezers with a nitrogen pool in the bottom naturally tend to stratify in temperature. All heat coming into the freezer warms the vapor which becomes less dense and rises to the top. Since most LN2 freezers have top openings, the majority of the heat coming into the freezer comes in at the top in the first place and isn't effectively absorbed by the liquid at the bottom. This adds to the stratification problem.

Second, the liquid nitrogen is stored at atmospheric pressure and hence it's temperature is always approximately −196° C. As a result, if all of the stratification in the dewar is eliminated, the temperature therein will be approximately −196° C.

Furthermore liquid nitrogen freezers require a system to replenish the LN2 as it is consumed. This increases installation costs (i.e. piping and tank capital expenses), and, in some areas of the world, the cost of the sacrificial LN2 is quite high.

DETAILED DESCRIPTION OF EMBODIMENTS

Figure 1:
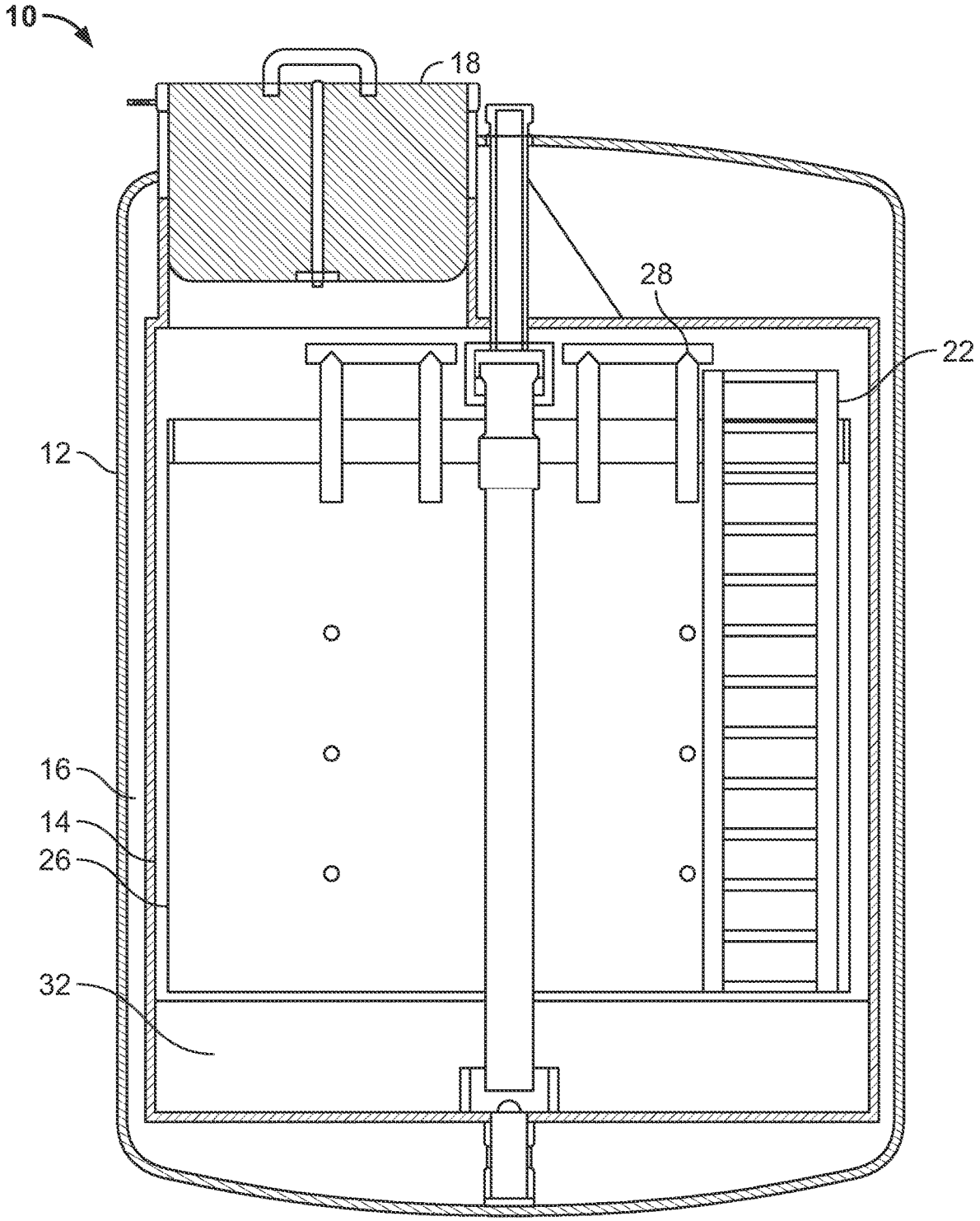
FIG. 1 (Prior Art)
FIG. 1 is a cross sectional side view of a prior art cryogenic dewar.
Figure 2:
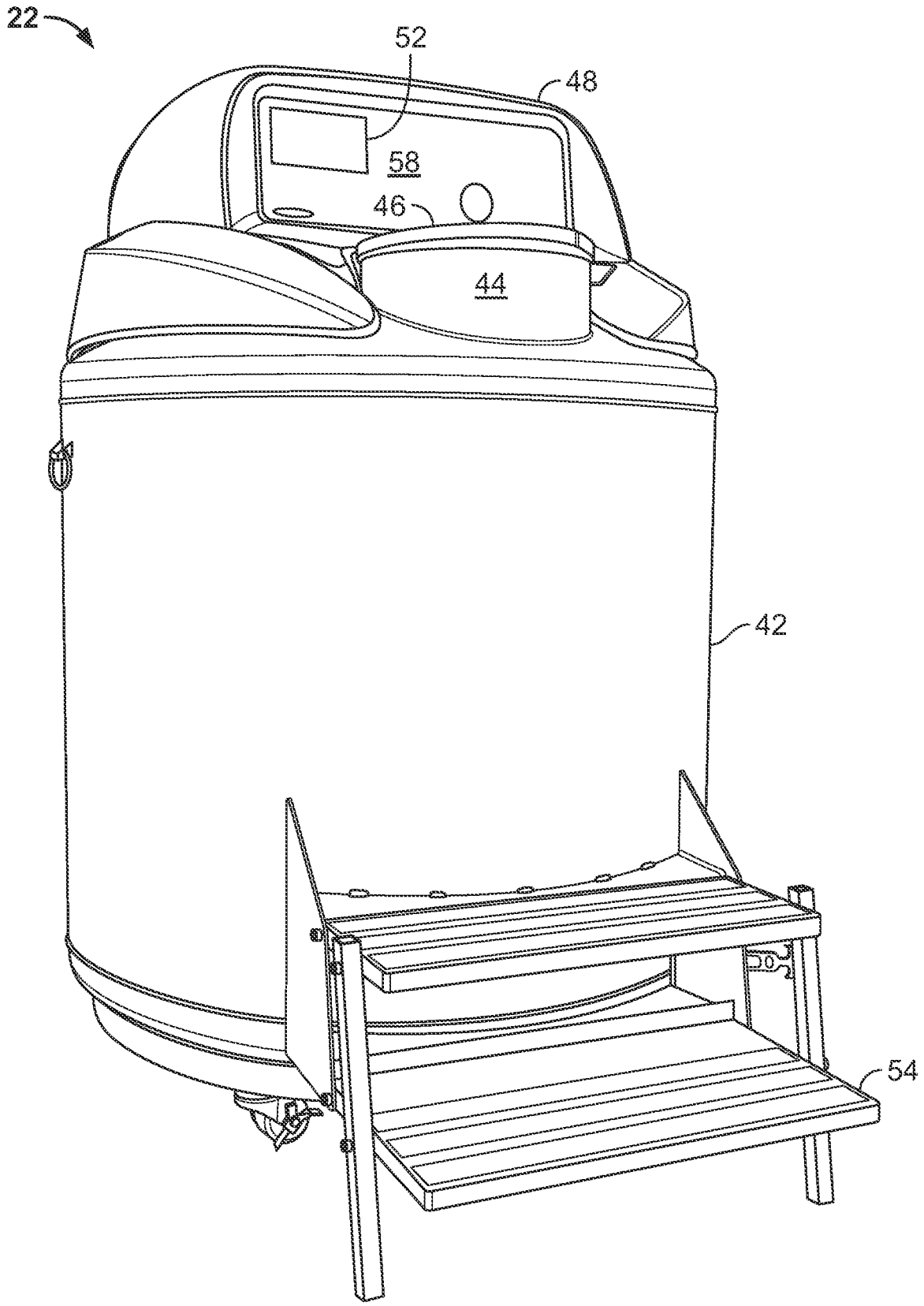
FIG. 2 is a perspective view of an embodiment of the cryogenic freezer of the disclosure.

An embodiment of the cryogenic freezer of the disclosure is indicted in general at 40 in FIG. 2. The freezer includes a storage dewar 42. While a cylindrical dewar is illustrated, the dewar may feature an alternative shape. As is known in the art, the dewar features an outer wall/outer sleeve and an inner wall/inner jacket with the space between the two evacuated of air to provide vacuum insulation. An access neck 44 is positioned on top of the dewar and defines an access opening through which the interior storage space of the dewar may be accessed. A lid 46 covers the access opening. A shroud 48 is also positioned on top of the dewar and features an opening through which a control panel 52, which features a touch screen and a display, may be accessed and viewed. As an example only, the shroud 48 may be molded from plastic. Stairs 54 enable a user to more easily access the access neck 44 and the control panel 52.

Figure 3:
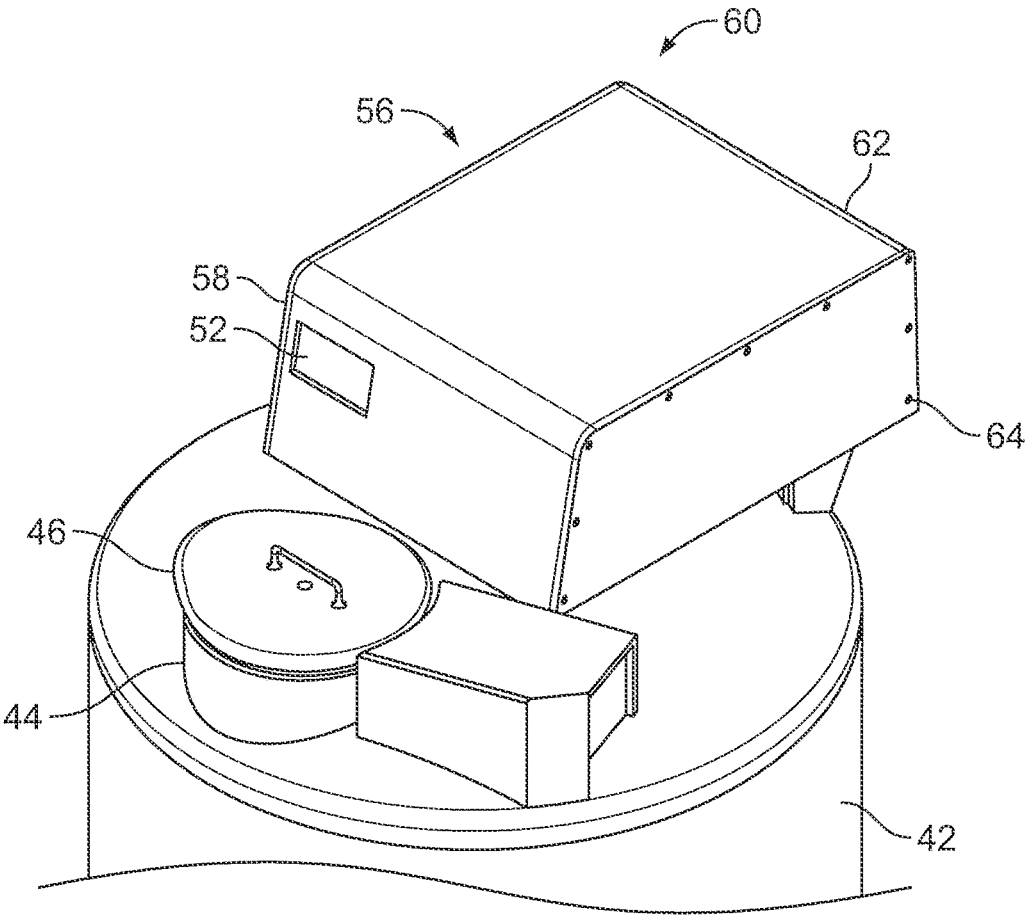
FIG. 3 is front top perspective view of the top portion of the freezer of FIG. 2 with the shroud removed.
Figure 4:
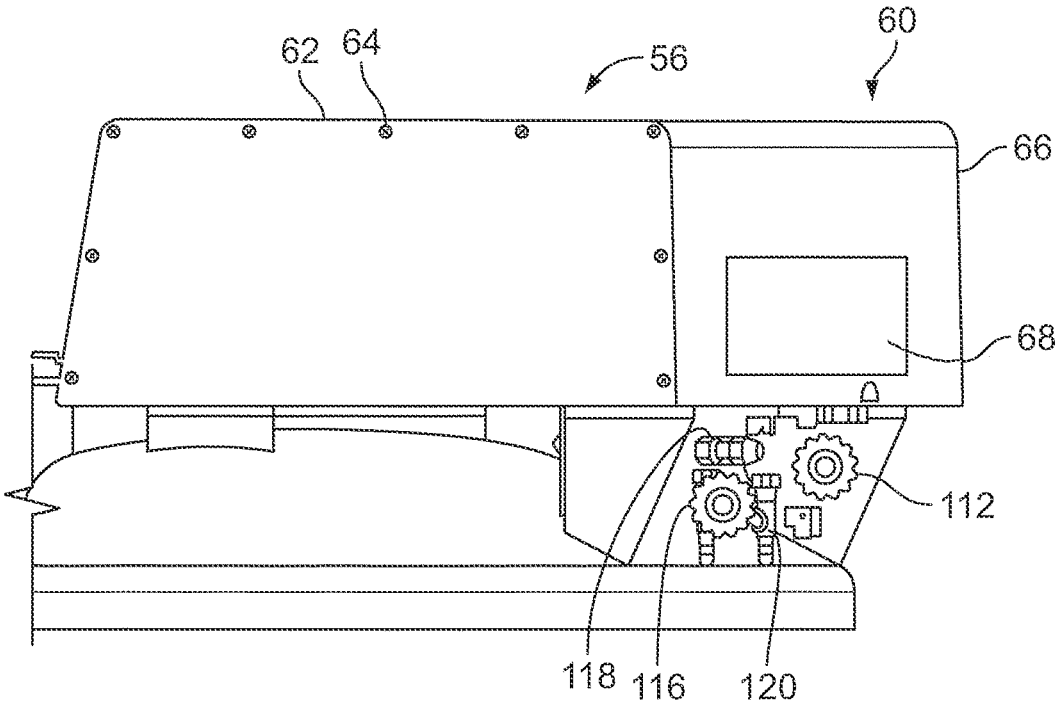
FIG. 4 is a rear side perspective view of the top portion of FIG. 3.

As illustrated in FIGS. 3 and 4, where the shroud has been removed, a refrigeration module, indicated in general at 60, includes a housing, indicated in general at 56. As may be seen from FIGS. 2 and 3, the control panel 52 is mounted in the front wall 58 of the housing. The housing also features a removable cover 62 that is preferably held in place by screws 64 (although other fasteners may be used). As illustrated in FIG. 4, the back panel 66 of the cover 62 of the housing is provided with cooling slots 68, the functionality of which will be explained below. The housing preferably is constructed from metal, but alternative materials may be used.

Figure 5:
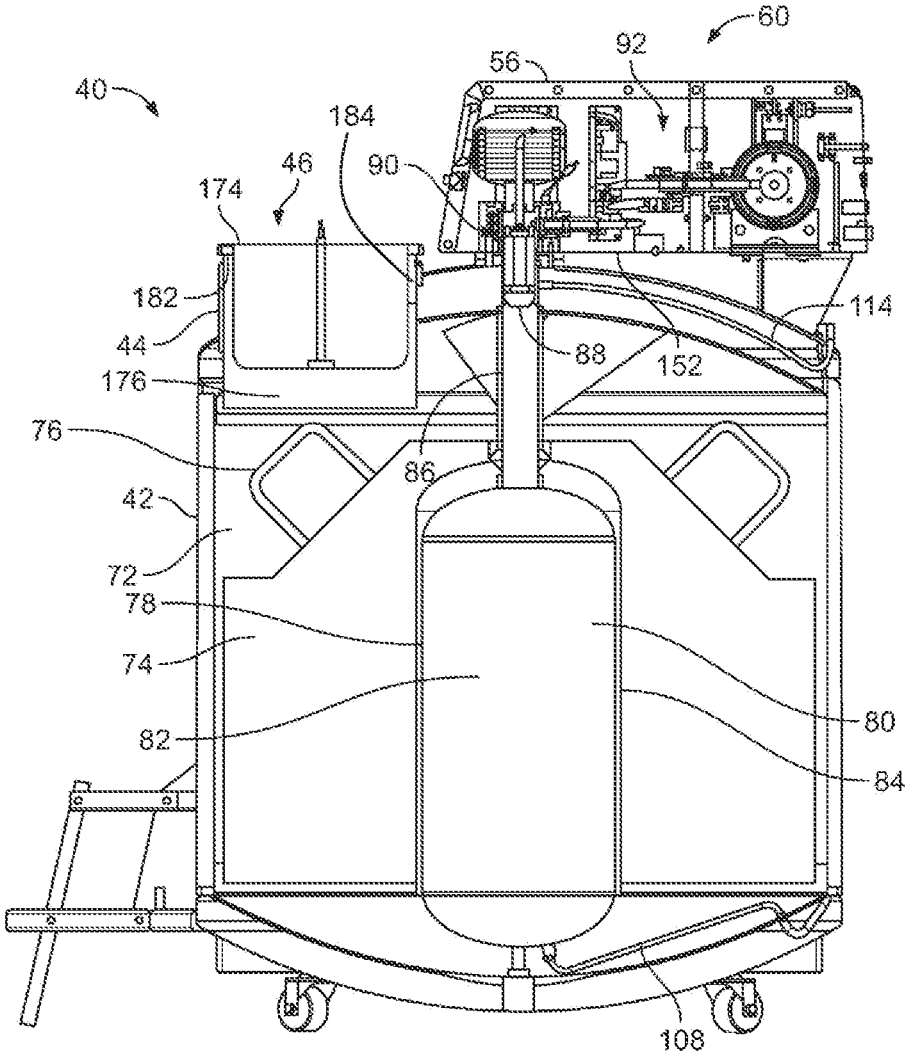
FIG. 5 is a cross sectional side view of the freezer of FIGS. 2-4.

A cross sectional view of the freezer 40 (with the shroud 48 of FIG. 2 removed) is provided in FIG. 5. An interior storage space 72 is defined by the dewar 42 and features a rotating rack or turntable having divider walls 74. Each divider wall is provided with a handle 76 so that the rotating rack or turntable may be rotated to provide access to the biological specimens, or other materials, stored in the sections of the rack.

A cylindrical reservoir 78 is positioned in the center of the storage space 72 and defines a reservoir interior space 80 that holds a cryogenic liquid 82 with a headspace above the cryogenic liquid. The reservoir interior space 80 is sealed with respect to the storage space 72 of the dewar (i.e. there is no fluid communication between the two), but the storage space is cooled by heat transfer through the walls of the reservoir, which is preferably constructed from a metallic material. As an example only, the cryogenic liquid may be, and is preferred to be, liquid nitrogen (LN2). The divider walls 74 of the rotating rack or turntable feature cutouts 84 so that they may rotate about the reservoir as the rack is rotated via the handles 76.

A cylindrical reservoir neck 86 extends up from the reservoir 78 and features a lower end that is in fluid communication with the headspace (and the rest of the reservoir interior space 80). The upper end of the reservoir neck 86 receives a coldfinger and cold tip portion 88 of a cold head, indicated in general at 90, of the refrigeration module 60.

Figure 6:
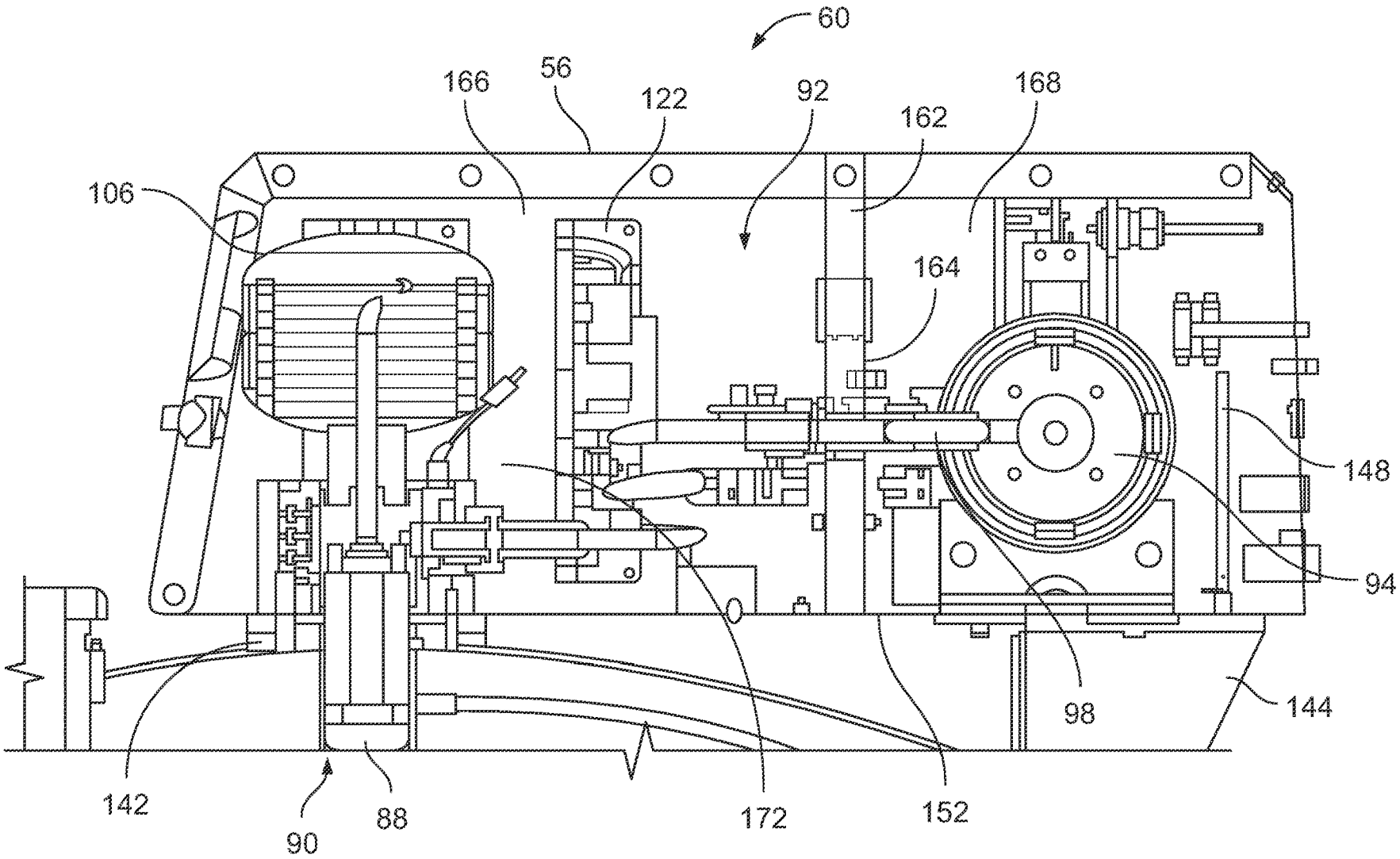
FIG. 6 is an enlarged cross sectional side view of the refrigeration module of FIG. 5.

An enlarged view of the refrigeration module is provided in FIG. 6. The refrigeration module 60 uses a mechanical refrigeration device that uses a cryogenic fluid as the refrigerant, hereinafter referred to as a "cryocooler," to provide refrigeration to cold tip 88. The cryocooler is indicated in general at 92 in FIGS. 6 and 7 and, as illustrated in FIG. 6, is positioned within the housing 56. As an example only, the cryocooler may use the Accoustic-Stirling ("pulse-tube") refrigeration cycle, and may be the QDRIVE cryocooler available from Chart Industries, Inc. of Ball Ground, Georgia.

Figure 7:
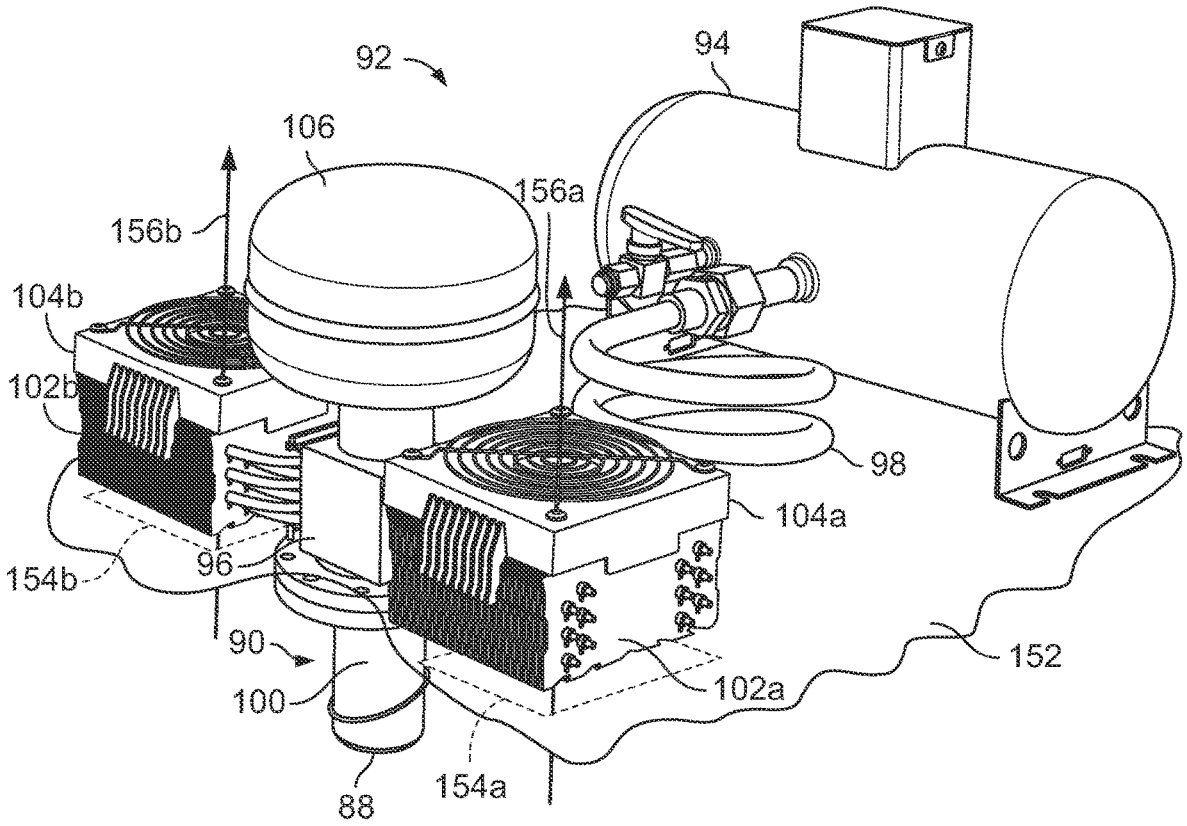
FIG. 7 is a perspective view of the cryocooler and a portion of the housing bottom or floor panel of the freezer of FIGS. 2-6.

As illustrated in FIGS. 6 and 7, the cryocooler 92 may include a pressure wave generator 94 that is connected to a heat rejection core 96 via a transfer line 98. The cold head, indicated in general at 90, extends down from the heat rejection core 96 and includes the cold finger 100 which terminates in the cold tip 88. A pair of heat sinks 102*a* and 102*b* are positioned on opposite sides of the heat rejection core 96 and are provided with electric fans 104*a* and 104*b*. A compliance tank 106 contains a coiled inertance tube that is also connected to the cold head 90. In operation, the pressure wave generator 94, which includes electric linear reciprocating motors, provide pressure waves in the cryocooler's internal helium gas. Through cooling of the gas within the heat rejection core (with heat being withdrawn via the heat sinks 102*a* and 102*b*) and expansion of the gas within the cold head 90 via a virtual piston effect in the inertance tube (in compliance tank 106), refrigeration is provided to the cold tip 88.

Additional details regarding the embodiment of the cryocooler 92 described above may be found in U.S. Pat. No. 7,628,022 to Spoor et al. and U.S. Patent Application Publication No. US 2015/0033767 to Corey et al., the contents of each of which are hereby incorporated by reference in their entirety.

Alternative types of mechanical refrigeration devices using alternative refrigeration cycles known in the art may be used in place of the cryocooler 92 of FIGS. 5-7.

As illustrated in FIG. 5, a lower conduit 108 is connected to the bottom of the cryogenic reservoir 78 and travels to a fill valve 112 of FIG. 4, which is also connected to an LN2 filling port/fitting. An upper conduit, illustrated at 114 in FIG. 5, connects to the head space of the reservoir, a reservoir vent valve (116 in FIG. 4), a safety blow-off or burst valve (118 in FIG. 4) and an ambient pressure lead (120 in FIG. 4). During re-filling of the cryogenic reservoir 78, a source of LN2 is connected to the filling port/fitting, and fill valve (112 of FIG. 4) and reservoir vent valve (116 of FIG. 4) are opened. As a result, the reservoir is filled from the bottom with LN2 via lower conduit 108. The valves are closed and the LN2 source is disconnected when the reservoir 78 is filled to the proper level with LN2.

With reference to FIG. 6, electronics 122 are also positioned within the housing 56 of the refrigeration module 60, and include an absolute pressure sensor, a differential pressure sensor and a system controller. The system controller, which may be a microprocessor or other electronic programmable device, is connected to the absolute pressure sensor and the differential pressure sensor so as to receive signals from the two pressure sensors. The absolute pressure sensor is connected to the upper conduit 114 (FIG. 5) and determines the absolute pressure within the reservoir 78, that is, the pressure within the head space of the reservoir 78 minus the ambient pressure from the ambient pressure lead 120 of FIG. 4.

The differential pressure sensor of electronics 122 connects to lower conduit 108 and upper conduit 114 and, using the reservoir headspace and bottom (of the liquid) pressures received, computes the liquid level within the reservoir. Such differential pressure liquid level sensors are known in the art. If the system controller detects, via the differential pressure sensor, that the cryogenic liquid level within the reservoir 78 drops below a predetermined level, an alarm is sounded indicating to the user that a reservoir refill is necessary.

In addition, a temperature sensor may be positioned in the storage space of the dewar and connected to the system controller (which also communicates with the control panel 52 of FIGS. 2 and 3) so that the temperature in the storage space may be displayed on the control panel. Additional temperature sensors may also be positioned in the storage space and provided with hookups for external equipment or systems.

The remaining functionality of the system controller will now be explained.

Control Strategy

The purpose of the operating control performed by the system controller (part of the electronics 122 of FIG. 6) is to, with reference to FIG. 5, respond to varying heat loads on the storage space 72 of the dewar 42 with corresponding responses in heat extraction or cooling/refrigeration levels by the cryocooler 92 via the liquid reservoir 78 between them, thereby to maintain the cold temperature in the storage space with little to no loss of reservoir contents and with minimal temperature variation in the storage space.

Figure 8:
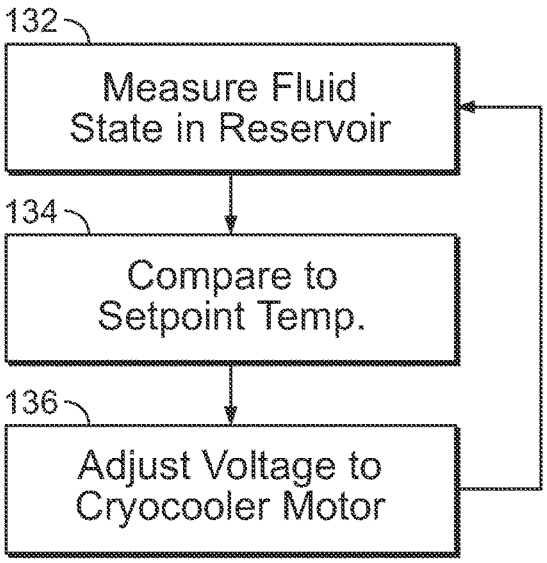
FIG. 8 is a flow chart of the processing performed by the system controller of the freezer of FIGS. 2-6.

In order to achieve the above, the system controller performs the processing illustrated in FIG. 8. As indicated by block 132 of FIG. 8, the system controller first measures of the fluid state in the reservoir (78 of FIG. 5). The reservoir contains mostly liquid but also some vapor in the headspace above it. As the reservoir is closed and substantially at saturation equilibrium in its closed containment, physical law links temperature and pressure such that measuring either property implies the other. When heat is added to the storage space, such as by normal leak through the insulation, opening the access neck or by insertion of material warmer than the storage space, that heat is absorbed by the cryogenic liquid in the reservoir. This causes the temperature and pressure of LN2 and associated vapor in the reservoir to rise slightly. Similarly (though unusually), if a mass were inserted at an initial temperature lower than the rest of the storage space, the chilling effect would cause the reservoir to cool, reducing its temperature and pressure slightly. It is generally preferable to measure condition changes in the reservoir as a pressure change because of the greater accuracy and reliability of inexpensive pressure sensors, relative to inexpensive temperature sensors.

The reading of the absolute pressure sensor is provided to the system controller which compares it to a pre-selected setpoint temperature (block 134 of FIG. 8), as desired for the storage space. A small static difference may be defined, to account for the steady-state heat leak to the reservoir from the outside surroundings, via the storage space. The difference between reservoir reading and setpoint, accounting for any intended difference, is input to a conventional proportional-integral control algorithm (well known in the art) that, as indicated by block 136 of FIG. 8, outputs a voltage to the motors of the cryocooler (92 of FIGS. 5-7) which voltage modulates the motors' power and thereby the cooler's refrigerating capacity, to diminish and eliminate the deviation. That is, the cooler receives a larger voltage than its steady state running level when added heat, absorbed by the liquid, raises the pressure in the reservoir, and that voltage remains higher than normal until the previous steady-state condition is restored.

Although the raised pressure in the reservoir means that some of the liquid there has boiled into vapor, no reservoir contents are lost under normal conditions. When the cooler is receiving the larger voltage described above, it re-condenses some of the vapor in the headspace, and the resulting liquid is returned to the reservoir liquid pool below.

The reservoir is fitted with safety relief devices (such as safety blow-off or burst valve 118 of FIG. 4) to allow escape of vapor under emergency conditions when anomalous gross heating (such as insulation failure) might overwhelm the cryocooler, or in case of extended, unaddressed cooler failure; but under ordinary operating conditions, the normal target pressure is substantially below that safety relief pressure. For example, the target operating pressure of the freezer may be set to about 25 psig, with the safety relief at 40 psig. That 15 psi difference corresponds to a rise in saturation temperature of oxygen (the preferred species in the reservoir) from 90° to 97° Kelvin (−183° to −176° Celsius), still well below the safe long-term storage temperature for biological materials, generally taken to be about 136° K (−137° C.), the glass transition temperature of water ice. As another example, the freezer may have set points at 22 psig and safety pressure relief set at 50 psig.

The proportionality constants in the control algorithm are preferably set to bring the cryocooler to full (maximum) capacity across a deviation of about 5 psi, and that maximum cooling capacity is about 2 times the steady-state heat leak, so that in ordinary operation, the cooler has more than enough capacity to restore the normal conditions after a heat addition (from introduction of new materials) without exceeding the safe pressure limit.

Figure 9:
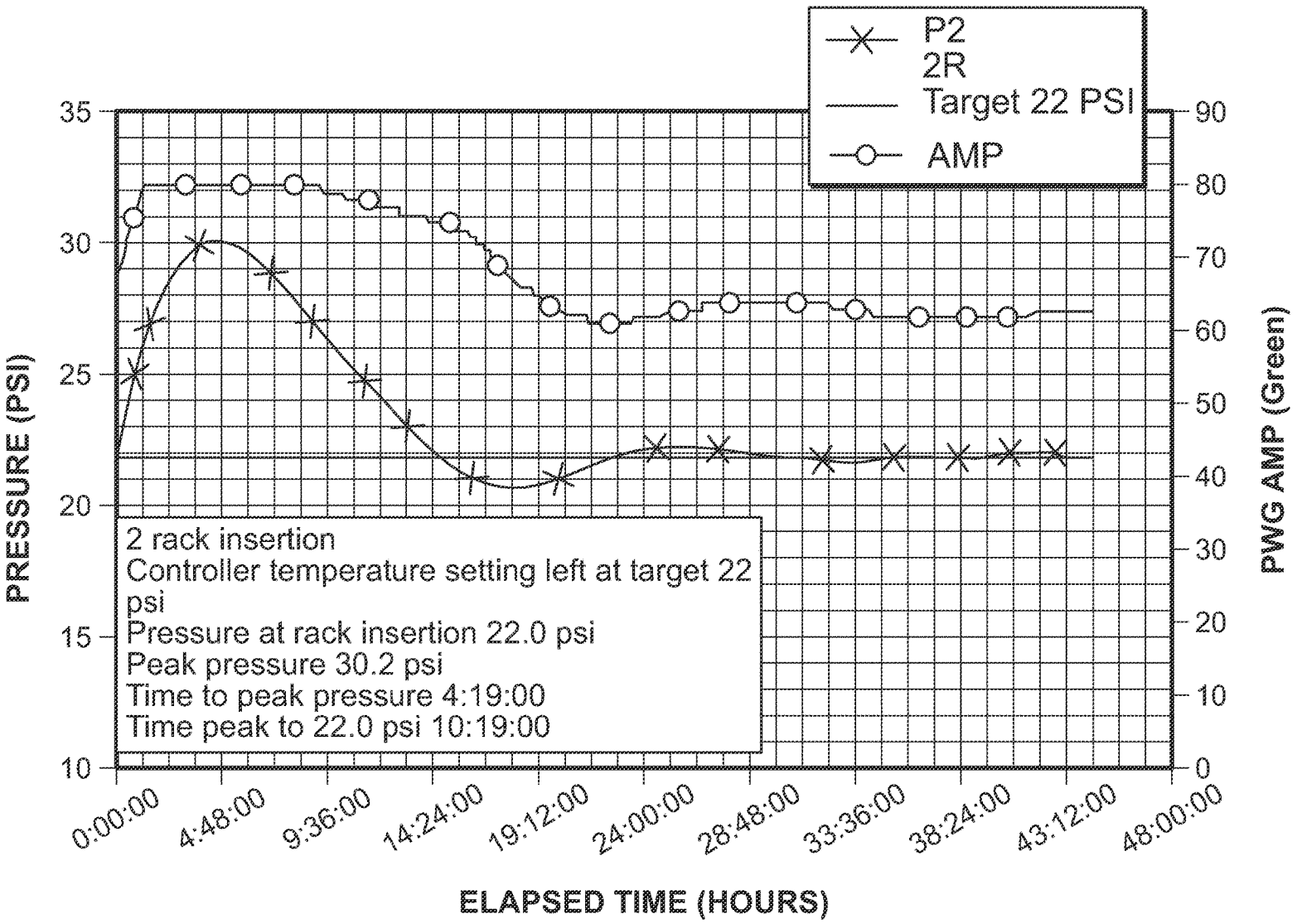
FIG. 9 is a graph of the storage temperature, reservoir pressure, and cryocooler current in response to insertion of racks into the dewar of the freezer of FIGS. 2-6.

A graph of the storage temperature, reservoir pressure, and cryocooler current (responding to applied voltage) in response to insertion of two warm racks, is shown in FIG. 9, illustrating the function and performance of the control system.

Notable benefits of this control system include:

(1) No consumption of or need to replace, cryogen under normal operating conditions;

(2) Power consumption (running the cryocooler) matches the demand and thereby minimizes start-stop cycles and total energy use;

(3) Modulated cooling, rather than start-stop cooling minimizes thermal excursions in stored materials and so extends usable life thereof by minimizing freezer-burn effects;

(4) Safety for stored materials in event of insulation, power supply or cooler failure, as the liquid must rise first to the safety relief pressure, and then fully boil and vent before significant temperature rise occurs. Such has been shown by monitoring storage temperature with cooler power switched off, illustrated in the graph provided in FIG. 10.

Steps for Change-Out of the Refrigeration Module

As described above, embodiments of the freezer include a vacuum-insulated container (dewar) with a central reservoir vessel for cryogenic fluid (typically liquid nitrogen or oxygen), and a refrigeration module, indicated at 60 in FIGS. 3-6, addressing and cooling the contents of the reservoir. The refrigeration module 60 and its interface with the reservoir (78 of FIG. 5) is unique and novel, with benefits to the manufacture, use and field repair of the freezer.

In service, the freezers of the disclosure are used to store extremely valuable (and often irreplaceable) biological materials that are compromised or destroyed by even brief exposures to temperatures above about 135° K. When there is a failure of refrigeration in prior art freezers, it has been necessary to transfer such materials from the failed freezer to another (if available with sufficient space) quickly, to minimize icing in open air and avoid damage to the materials. This is a fraught process, laborious, risky to both materials and workers, and not always successful.

Figure 10:
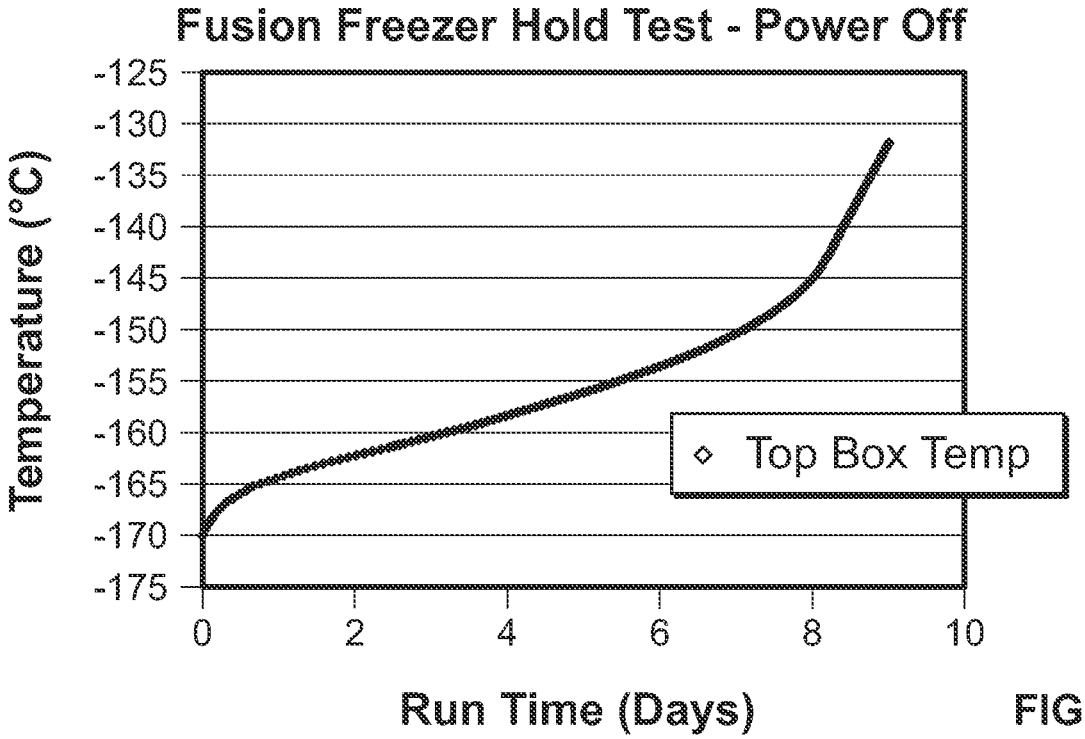
FIG. 10 is a graph of storage temperature over time with the cryocooler power switched off for the freezer of FIGS. 2-6.

With the freezer of FIGS. 2-6 and, its unique refrigeration module 60, it is possible to repair and recover full cooling without ever contacting or moving the stored materials. The sequence for such repair is as follows:

(1) Refrigeration fails (mechanical or electrical breakdown);

(2) Alarm signal alerts user to problem: user calls for replacement;

(3) Pressure in reservoir begins slow rise as heat leak through storage insulation continues (as shown in FIG. 10);

(4) New refrigeration module arrives on site;

(5) Electrical power is disconnected from module;

(6) Reservoir relief valve (116 in FIG. 4) manually opened to vent reservoir to atmospheric pressure (some loss of cryogen, but cooling effect of venting minimizes loss to a small portion, for example 7-12% depending on initial pressure between 22 and 50 psig);

(7) Cover (62 of FIGS. 3 and 4) is removed from the refrigeration module housing (56 of FIGS. 3 and 4), exposing fasteners attaching the cryocooler to the dewar;

(8) Screws are removed from the cryocooler-to-dewar attachments at both the coldfinger flange on the reservoir (142 in FIG. 6) and the refrigeration module support brackets (144 in FIG. 6)—of course fasteners other than screws may be used in alternative embodiments;

(9) Failed refrigeration module is lifted off of the dewar and set aside for repair off-site;

(10) Reservoir continues to vent vapor, now through open neck flange where coldfinger has been removed—this venting prevents air and moisture from entering the now unsealed reservoir while open;

(11) New module is set in place with new gasket on coldfinger flange;

(12) Screws to seal coldfinger to reservoir and module to support brackets are replaced;

(13) Electrical power is re-attached and cooler operation initiated and verified;

(14) Module cover (62 of FIGS. 3 and 4) is replaced; Reservoir relief valve (116 of FIG. 4) is closed;

(15) Lost cryogenic liquid is replaced, if needed (this can be done later in some situations, for example, if down time was less than 3-5 days);

(16) Freezer is returned to user service with no handling or significant rise in temperature of sample in freezer;

(17) Failed module is packed for shipment to repair facility.

By comparison, prior art mechanical freezers require removal and relocation of stored materials and extensive disassembly of their refrigeration units, including evacuation and recharging of refrigerant, in the event of mechanical or electrical failure. In addition to the risk to the stored materials, such transfer requires considerable time spent by the user to carefully prepare alternate locations, log the individual materials involved, move and later retrieve those materials, and assure maximum temperature limits are not exceeded throughout the process. Notably, such failures typically occur every few years with conventional mechanical freezers.

Noise and Electromagnetic Interference Benefits of Top Enclosure

As described above, embodiments of the freezer of the disclosure may include a top enclosure having two layers of enclosure to address audible noise and electromagnetic interference (EMI) emissions (such emission being typical of all electrical and mechanical devices).

More specifically and first, as described above and illustrated in FIGS. 5 and 6, the refrigeration equipment, including the cryocooler, the system controller and associated heat exchangers and fans, is enclosed in housing 56, which is preferably constructed of metal. The housing, acting as a Faraday cage, reduces EMI emissions from the electrical equipment within. As illustrated in FIG. 4 and noted above, the back panel 66 of the housing is provided with cooling slots 68 for cooling air flow. A baffle wall, indicated at 148 in FIG. 6, is positioned within the housing 56 and opposes the cooling slots to provide a baffle that reduces noise and EMI transmissions through the slots. It should be noted that another air outlet opening configuration could be substituted for the cooling slots 68.

The second and outer layer of enclosure is provided by the shroud 48 of FIG. 2. The shroud 48, which is preferably made from a polymeric material, has the effect of containing and reflecting internally the acoustic emissions of the cryocooler and fans. The shroud also provides an aesthetic enhancement.

Cooling air flowing through the housing 56 is exhausted out the back of the housing so that it flows away from users, thus further reducing the noise levels experienced by the users. More specifically, the housing features a floor panel, indicated at 152 in FIGS. 5-7. As indicated in FIG. 7, a pair of air intake openings 154*a* and 154*b* are positioned under the heat sinks 102*a* and 102*b* of the cryocooler. The fans 104*a* and 104*b* of the heat sinks are configured so that when they are operating, air is pulled into the interior of the housing through the air intake openings 154*a* and 154*b*, as indicated by arrows 156*a* and 156*b*.

With reference to FIG. 6, a divider wall 162 extends floor-to-ceiling and wall-to-wall within the housing. An electric fan, indicated at 164 in FIG. 6, is mounted within the divider wall and configured so that it blows air from the front compartment 166 to the rear compartment 168 and ultimately out of the cooling slots 68 (FIG. 4) of the housing, as indicated by arrow 172 of FIG. 6. As a result, cooling air flows over the electronics 122. Furthermore, the divider wall prevents recirculation of air from the rear compartment 168 of the housing back to the front compartment 166 so that noise migration from the pressure wave generator motors 94 of the cryocooler to the front of the freezer is reduced. The divider wall 162 preferably includes a layer of foam with a recess and opening(s) to accommodate the fan 164.

Anti-Icing Features

The embodiments of the freezer described above differ from prior art freezers using similar vacuum-insulated dewar construction (typically cooled by lost liquid nitrogen in an open pool at the bottom of the storage space), in that absent such nitrogen vapor, the storage space is filled with ordinary air, including such moisture as its humidity presents. Furthermore, with each access opening during operation of the freezer, new air and additional moisture may be introduced to the storage space of the dewar. Because of the low temperature in the storage space, such moisture rapidly freezes and over time may accumulate in excessive amounts, inhibiting handling of materials stored. The freezer may optionally include mitigating features to address the build-up of ice.

With reference to FIG. 5, and as noted previously, a lid 46 seals the access opening of the access neck 44. The lid 46 includes a circular top plate 174 to which is attached a plug 176. As examples only, the lid top plate 174 may be constructed from plastic and the plug 176 may be constructed from foam or cork. In some embodiments the plug may be sized to engage the inner surface of the access neck 44.

An annular rim is formed on the underside of the top plate 174 that surrounds the upper end of the plug 176, and a gasket ring, indicated at 182 in FIG. 5, is positioned under the annular rim. The gasket ring 182 engages the top edge of the access neck sidewall when the lid is in the closed condition. The neck may also be provided with a gasket in the form of a sleeve 184 (such as a rubber or silicone cylinder) that is circumferentially folded over the top edge of the sidewall of the access neck 44. In addition, the lid 46 and access neck 44 may be provided with a latch that pulls the gasket ring down against the upper edge of the access neck sidewall to secure the plug-to-neck joint when closed, thereby blocking the flow of air and moisture into the storage space when the dewar is closed.

Given that ice is most likely to form on the inside of the access neck when the plug is removed (the first cold surface encountered by entering air), the neck may be fitted with a cylindrical sleeve-like liner (that covers at least a portion of the inner surface of the access neck) made of flexible icephobic materials like silicone. Ice will still form there, but periodically, the sleeve (which may be formed as part of and an extension to the sealing gasket at the top of the access neck sidewall described above) may be lifted out along with such ice thereon, and flexed, much like a domestic ice-cube tray at home, to release that ice away from the dewar, and then replaced in the neck, free of ice.

In addition, the turntable within the storage space may be fitted with lightweight liners that hang from the tops of the turntable divider walls (74 of FIG. 5) and provide a removable sack-like element that encloses the space of each segment into which stored materials are placed. Again, periodically, these liner sacks can be removed and replaced, ether by new, dry ones, or the original ones once dried. One variation of this liner concept is to provide liners with a silicone outer surface that would not stick to the turntable, but with a dessicant-infused inner surface that attracts and captures water vapor therein.

Figure 11:
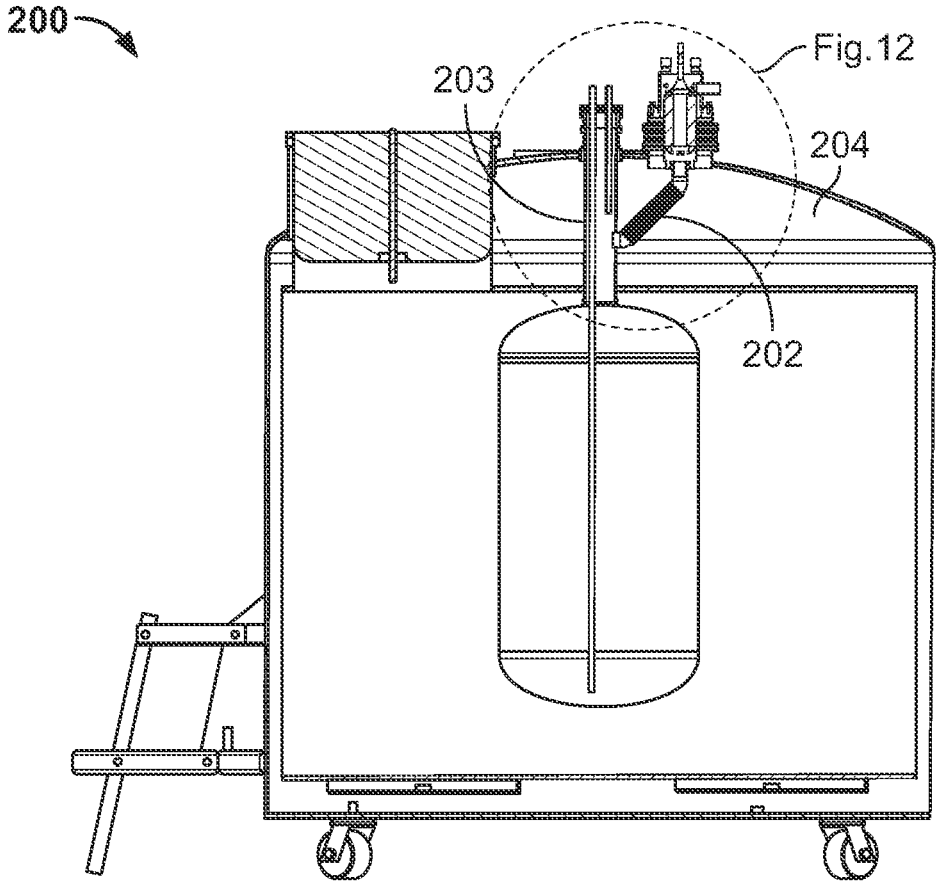
FIG. 11 is a cross sectional side view of a second embodiment of the cryogenic freezer of the disclosure.
Figure 12:
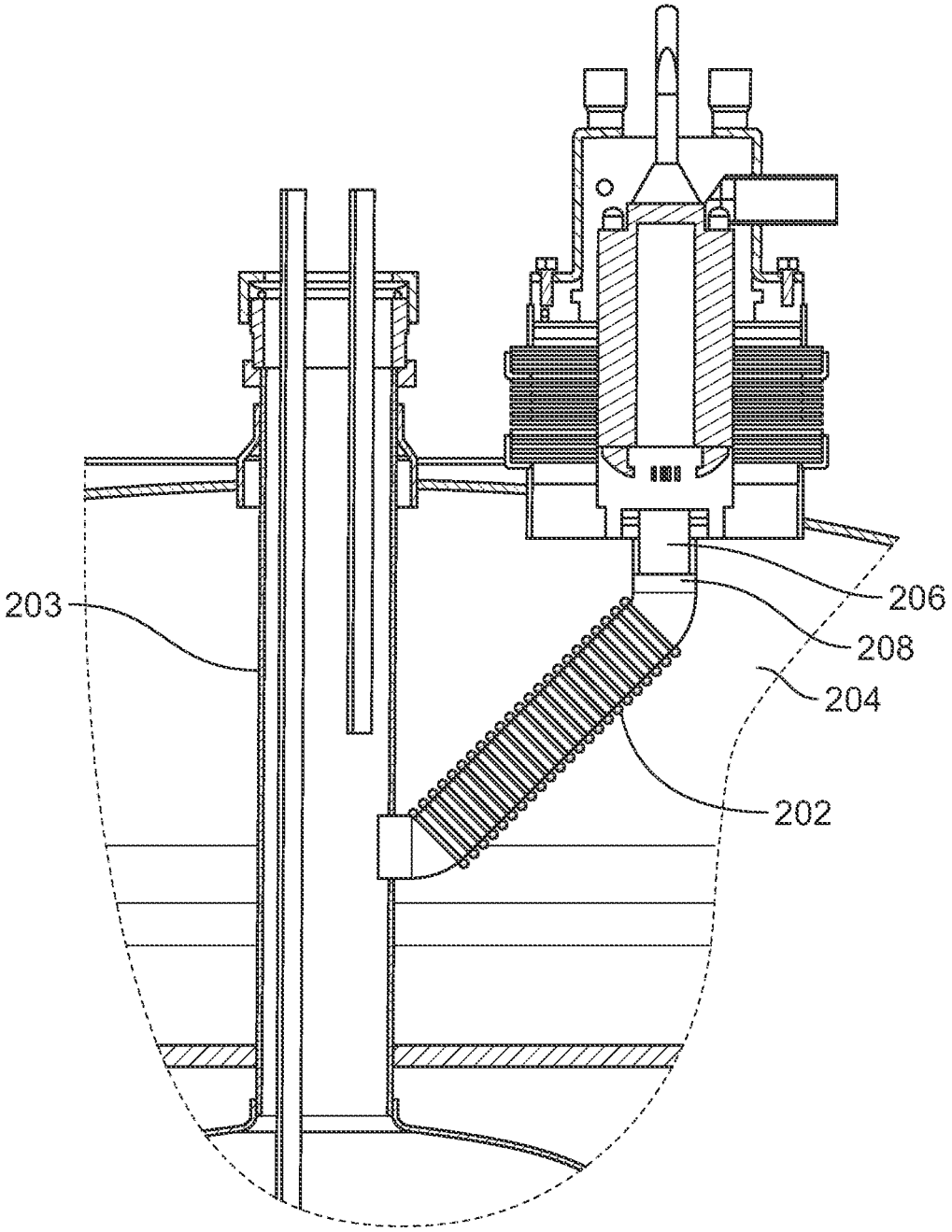
FIG. 12 is an enlarged cross sectional side view of the upper portion of the dewar of the freezer of FIG. 11.

With reference to FIG. 7, a temperature gradient exists in the cold finger 100, with the coldest part of the coldfinger located at cold tip 88 (i.e. at the lower end of the coldfinger), and the warmest part of the coldfinger at the upper end. In the embodiment of the freezer illustrated in FIG. 5, the coldfinger is positioned within the reservoir neck 86. As a result, the warmest portion of the cold finger is positioned within the reservoir neck 86 so that an additional heat leak into the reservoir and dewar storage space is present. In an alternative embodiment of the freezer, indicated in general at 200 in FIG. 11, a vapor branch conduit 202 is in fluid communication with the reservoir neck 203 of the freezer and passes through the vacuum space 204 at the top of the dewar (also shown in FIG. 12) and connects the reservoir vapor only to the cold tip of the coldfinger 206. As a result, as illustrated in FIG. 12, the remaining surfaces of cold finger 206 of the cryocooler are surrounded by the vacuum space 204 with only the cold tip 208 positioned within the vapor branch conduit 202. As a result, heat transfer from the warmest portion of the coldfinger 206 to the reservoir and dewar storage space is virtually eliminated, which may increase the efficiency of the freezer. The remaining details and components of the freezer of FIGS. 11 and 12 are the same as, or similar to, those described above for the embodiment of FIG. 5.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A cryogenic freezer comprising:

a container defining a storage space;

a reservoir vessel positioned within the storage space and configured to contain a cryogenic liquid with a headspace above the cryogenic liquid in a reservoir interior space that is sealed with respect to the storage space by a wall of the reservoir vessel;

a refrigeration module that is in a heat exchange relationship with a vapor in the headspace of the reservoir above the cryogenic liquid, wherein the refrigeration module includes a cold tip that is in the heat exchange relationship with the vapor in the headspace of the reservoir and that is positioned in an upper end of a reservoir neck;

a sensor configured to determine a pressure within the reservoir interior space; and a system controller connected to the sensor and the refrigeration module and configured to control an amount of cooling by the refrigeration module to the cold tip in the headspace of the reservoir when a pressure or temperature of the vapor within the headspace increases, wherein the wall of the reservoir vessel cools the storage space by heat transfer through the wall of the reservoir vessel and prevents fluid communication between the storage space and the reservoir interior space.

2. The cryogenic freezer of claim 1, wherein the refrigeration module is removably mounted to the container.

3. The cryogenic freezer of claim 1, wherein the reservoir is secured within the container by the reservoir neck that is in fluid communication with the headspace of the reservoir.

4. The cryogenic freezer of claim 1, wherein the refrigeration module includes a housing, and wherein the housing includes a divider wall that separates an interior of the housing into a front compartment which includes the system controller and a rear compartment that includes a motor of the refrigeration module.

5. The cryogenic freezer of claim 4, wherein the housing includes an air intake opening positioned within the front compartment and an air outlet opening positioned in the rear compartment and further comprising a fan positioned in the divider wall and configured to pull cooling air into the housing through the air intake opening and exhaust air out of the housing through the air outlet opening.

6. The cryogenic freezer of claim 5 further comprising a baffle wall positioned within the rear compartment of the housing and opposing the air outlet opening.

7. The cryogenic freezer of claim 5, wherein the refrigeration module includes a heat sink positioned adjacent to the air intake opening.

8. The cryogenic freezer of claim 5, wherein the air outlet opening includes cooling slots positioned in a back panel of the housing.

9. The cryogenic freezer of claim 1, wherein the refrigeration module includes a housing that is removably mounted to the container and wherein the reservoir is secured within the container by the reservoir neck.

10. The cryogenic freezer of claim 9, wherein the cold tip is configured to be removable from the reservoir neck with the refrigeration module housing, wherein the refrigeration module housing is removable from the container.

11. The cryogenic freezer of claim 1, wherein the container comprises a dewar, wherein the dewar includes an inner wall surrounded by an outer wall with a vacuum insulation space there between.

12. The cryogenic freezer of claim 1, wherein the container includes an access neck defining an access opening with a lid removably covering the access opening, the lid including a top plate, a plug and a gasket ring, where the gasket ring engages the access neck to seal the access opening when the plug is received in the access opening to close the lid.

13. The cryogenic freezer of claim 12, wherein the access neck includes a gasket sleeve that is engaged by the gasket ring when the lid is in the closed configuration.

14. The cryogenic freezer of claim 13, wherein the gasket sleeve extends along an interior surface of the access neck and is removable to allow ice buildup to be removed from the container.

15. The cryogenic freezer of claim 1, wherein the refrigeration module is configured to run at a steady-state running level to provide cooling to the headspace of the reservoir to balance heat leak to the reservoir from outside environment.

16. The cryogenic freezer of claim 15, wherein the refrigeration module is configured to increase an amount of cooling to the cold tip in the headspace of the reservoir from the steady-state running level when the pressure or temperature within the headspace increases.

17. The cryogenic freezer of claim 16, wherein the refrigeration module is configured to condense vapor in the headspace of the reservoir when the refrigeration module is configured to increase the amount of cooling to the headspace of the reservoir from the steady-state running level.

18. The cryogenic freezer of claim 1, wherein the wall of the reservoir vessel cools a stored material in the storage space by the heat transfer through the wall of the reservoir vessel.

* * * * *